US005700231A

United States Patent [19]

Wilkinson

[11] Patent Number: 5,700,231

[45] Date of Patent: Dec. 23, 1997

[54] WEIGHT LOSS GARMENT

[76] Inventor: William T. Wilkinson, P.O. Box 73, Salem, N.J. 08079

[21] Appl. No.: 627,426

[22] Filed: Apr. 4, 1996

[51] Int. Cl.[6] ..... A63B 21/02

[52] U.S. Cl. ..... 482/124; 482/51; 482/74; 482/121

[58] Field of Search ..... 482/121, 122, 482/124, 125, 74; 2/69, 69.5, 78.1, 224; 128/782

[56] References Cited

U.S. PATENT DOCUMENTS

| | | | |
|---|---|---|---|
| 3,559,654 | 2/1971 | Pope, Jr. | 2/224 |
| 3,759,510 | 9/1973 | Jackson, Jr. . | |
| 4,910,802 | 3/1990 | Malloy . | |
| 5,033,123 | 7/1991 | Audet . | |
| 5,060,315 | 10/1991 | Ewing | 2/69 |
| 5,109,546 | 5/1992 | Dicker . | |
| 5,176,600 | 1/1993 | Wilkinson . | |
| 5,186,701 | 2/1993 | Wilkinson . | |
| 5,201,074 | 4/1993 | Dicker . | |
| 5,203,754 | 4/1993 | Maclean . | |
| 5,267,982 | 12/1993 | Sylvanowicz . | |
| 5,306,222 | 4/1994 | Wilkinson . | |
| 5,308,305 | 5/1994 | Romney . | |
| 5,367,708 | 11/1994 | Fujimoto | 2/69 |
| 5,375,610 | 12/1994 | LaCourse et al. | 128/782 |
| 5,465,428 | 11/1995 | Earl . | |

*Primary Examiner*—Lynne A. Reichard
*Attorney, Agent, or Firm*—Connolly & Hutz

[57] ABSTRACT

A new resistance, weight loss garment worn by user will elevate the heart rate of a user so that the user can expend more calories over an extended period. The garment would contain at least one article of clothing worn on the body of the user, said article of clothing incorporating elastic resistance structures that tend to oppose normal directions of motion thereby causing extra exertion by the user that results in burning more calories over a period of time.

19 Claims, 2 Drawing Sheets

WEIGHT LOSS GARMENT

BACKGROUND OF THE INVENTION

Aerobic exercise and weight loss are two of the major concerns of the public. The two are related, since aerobic exercise burns calories, and thus promotes weight loss. Current exercise and weight loss findings emphasize the value of exercising moderately, and losing weight gradually and evenly over time. Exercise and weight loss in smaller increments, on a regular basis lowers the risk of injury, is more tolerable, and promotes a safer and more sustainable workout and weight control program.

U.S. Pat. No. 3,759,510 describes an exercise garment including a helmet, jacket, armlets, gloves, belt, shorts, thigh leggings, calf leggings and boots with these components being detachably connected together for the use of a total composite garment or for the use separately in various combinations, each component of the total garment having exterior pockets which may be filled or partially filled with a particular weight material of various densities. This exercise garment is cumbersome and should be worn on the outside, not underneath the clothes.

U.S. Pat. No. 5,033,123 relates to a garment which comprises a pair of trousers and optionally a solid upper jacket to form a combination suit. This garment is worn in such activities as lumbering and sporting where consider body bending is involved. These trousers and jacket are worn on the outside, not as an undergarment.

U.S. Pat. No. 5,109,546 relates to an exercise suit with form fitting pants and pull-over top made of stretchable material having reinforcing segments with helically wound leg and arm resistance bands attached integrally to the suit.

It is a primary purpose of the invention to create a resistance garment that while comfortable, causes the wearer to gradually elevate his heart rate, and thus consume more calories over an extended period. Thus, this garment is designed to be worn primarily as an undergarment, and to be worn for a longer time, typically longer than a workout, such as during the entire workday. It is intended to be worn when not exercising. However, it is also possible with or without slight modifications to wear this garment during exercising.

SUMMARY OF THE INVENTION

An object of the invention is to provide a resistance garment to promote weight loss, by creating safe, modest and comfortable resistance load on the body during normal, everyday activities.

Another object of the invention is to provide a resistance garment to give added aerobic exercise, to strengthen the heart, during exercise and sports activities.

Another object of the invention is to strengthen and tone the body muscles.

Another object of the invention is to provide an exercise program that would permit a user to exercise while wearing the inventive resistant garment of this invention.

Another object of this invention is to provide a weight loss program, whereby a user can wear different thicknesses of the resistance garment by starting out with a thin garment and increasing to a thicker garment, thereby being able to gradually elevate the users heart rate and consume more calories over an extended period of time.

Another object of the invention is to create a resistant garment, that while comfortable, causes the wearer to gradually elevate his heart rate, and thus consume more calories over an extended period to exceed 1 or 2 or 8 hours over the cumulative caloric burn.

The garment is designed to be worn as an undergarment such as shorts and a tee shirt and to be worn for a longer time than a workout, such as during the entire workday. This garment can be worn but is not intended to be worn while exercising.

Another embodiment of this invention is drawn to an exercise resistance garment that can be worn over the clothing or underneath the clothing and over undergarments and provides resistance, thereby increasing the muscle tone of the user.

With respect to the first object, inducing a slight load over time, the cumulative daily result is substantial but yet easily tolerated by the user.

The invention also relates to a process for burning calories comprising a user placing the inventive garment on and wearing said garment for an extended period of time, thereby burning calories and after the user achieves the desired result, the user increases the level of calorie burning by changing the garment to a garment of greater resistance or by adjusting the resistance of the garment.

DETAILED DESCRIPTION OF THE INVENTION

Figure 1:
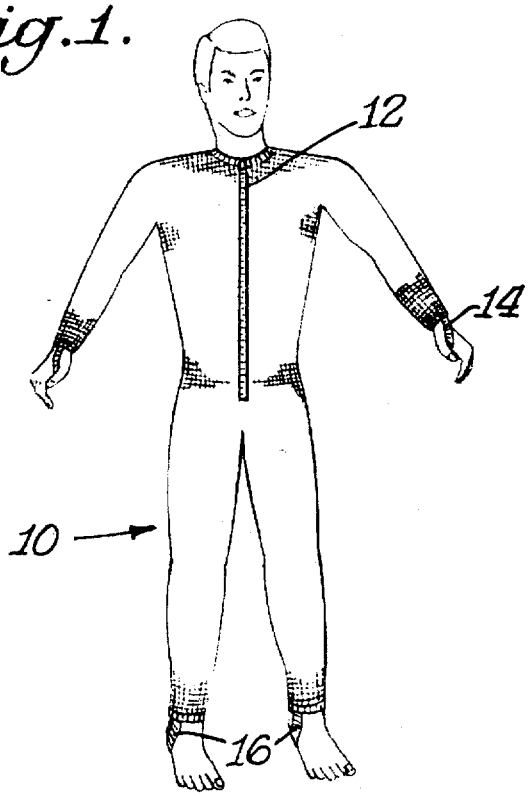
FIG. 1 shows a front elevational view of a one-piece resistance garment according to this invention.

FIG. 1 illustrates a one-piece resistance garment according to this invention. The one-piece resistance garment 10 is made from a stretchable material. In addition, the stretchable material can be, but is not limited to, an all mesh material; mesh material with web or solid panels; all web material; web material with solid elastic strips or panels; or all elastic material for comfort, coolness and lightweight. The elastic material can be, but is not limited to nylon, an elastic synthetic fiber known as LYCRA® sold by the DuPont Company, SPANDEX® (stretch fiber based on synthetic elastomeric long-chain polymers, the fiber returns to the original length after being stretched several times) or neoprene rubber. The garment can be manufactured in any known method to achieve one or more directional lines of stretch including, but not limited to, the warp knit, circle knit, weft insertion, continuous weave/variable density strips (the fabric is of continuous weave having fabric made from strips of different densities and elasticities). The panels can be on the garment, in the garment such as but not limited to being sewn into the garment, incorporated into the weave and made an integral part of the garment (of the same weave of the garment). The strips can be of the same material or of a different material from the garment.

There can be an access means 12, such as, but not limited to, any known attachment means such as, but not limited to, a zipper, buttons, snaps, clips or hook and loop tape known by its registered trademark VELCRO®. The access means 12 can be in the front, the back and/or the sides to permit easy entry into and removability of the garment 10. As shown in FIG. 1, the access means 12 is a zipper in the front of the garment 10.

Figure 4:
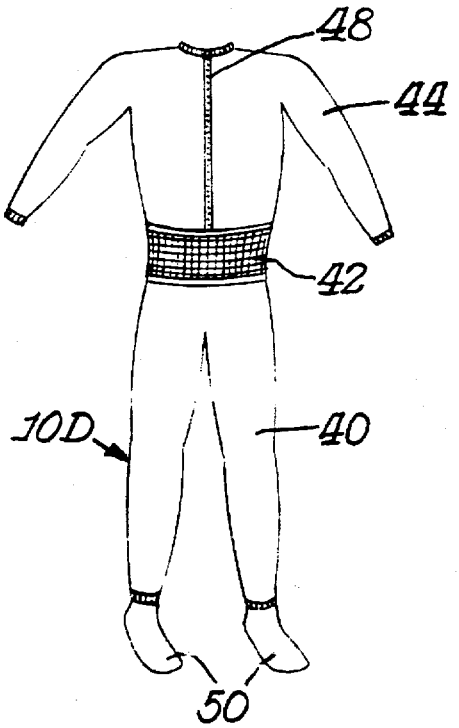
FIG. 4 shows a front elevational view of still another one-piece resistance garment according to this invention.

There would be a means to tighten the garment snugly on the user. One such means can be the material itself. Again, as stated above, the material could be a tight fitting resilient material that would be capable of stretching, thereby permitting the material to fit snugly on a user. In addition, hand stirrup(s) 14 could be attached to the garment 10 to form a snug fit of the garment 10 on the user. There can also be foot stirrup(s) 16 attached to the bottom of the legs of the garment 10. The hand stirrup(s) 14 and the foot stirrup(s) 16 would create additional tension on the garment 10, thereby causing the user to burn more calories without the user perspiring. In addition to, or instead of the foot stirrup(s) 16, there could also be socks or other means of attachment to the bottom of legs of the garment 10 such as shoes (as shown in FIG. 4). The garment 10 can also engage the hands with a loop or be attached to a glove or hand stirrup 14 to provide added tension for the upper body. However, it is believed that the engagement of the hands is less preferable and tolerable by the user during prolonged periods of use. Thus, engagement of the hands is more appropriate for the aerobic short term application than for the longer weight loss purpose. In addition, elastic can be built into the garment at varying locations such as in the sleeves, legs, front, back or sides, to permit the garment 10 to snugly fit to the user.

Again, the web, mesh, mat-like fabric has the benefits of being lightweight, comfortable, has coolness and breathability and is capable of being worn in the summer time as well as the winter, spring and fall seasons.

Figure 2:
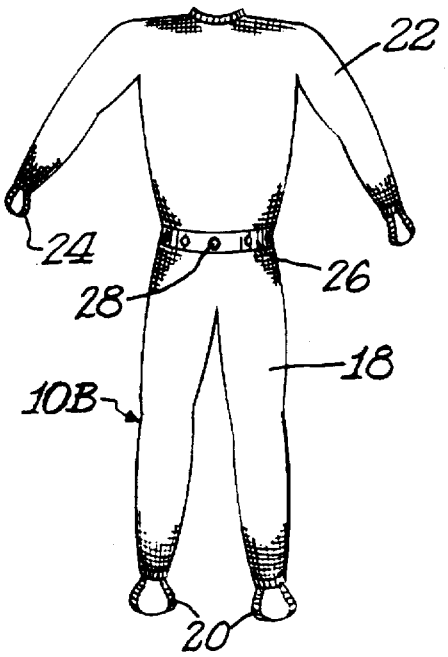
FIG. 2 shows a front elevational view of a two-piece resistance garment according to this invention.

FIG. 2 shows a front elevational view of a two-piece suit according to this invention. The two-piece suit 10B has pants 18 which could be made of a light-weight web, mesh or mat-like fabric for comfort and coolness or it could be a solid fabric construction or a combination of a web and solid pieces as described above for the one piece garment 10. The pants 18 could have a means that would provide extra tension at the bottom of the legs of the pants 18. The tightening means 20 could be, but is not limited to, a sock or foot stirrup connected to the pants. The user would wear the pants and place the user's feet in each of the foot stirrups 20, thereby causing a greater tension, which would pull the garment 10B tighter on the user's body. The upper piece of the suit 10B would be shirt or a top 22. The top 22 could be made of the same material and construction as described above for the one piece garment 10. It is also possible that the top 22 could have an access means as shown in FIG. 1 (access means 12). It is also possible that the top 22 can be a pull-over top without use of an access means. Additionally, hand stirrups 24 can be connected to the top 22. The hand stirrups can be the same as described in FIG. 1, and would enable the top to be pulled tighter on the user and cause the user to create more body heat, and burn more calories and loss more weight. There could also be a waist band 26 that could function as a belt and enable the suit 10B to be further adjusted around the waist of the user. The waist band 26 could also connect the pants 18 to the top 22. The waistband 26 could have an adjusting means 28 to adjust the fit around of the suit 10B around user's waist. The adjusting means 28 can be, but not limited to snaps, VELCRO® or buttons. The waistband 26 is also preferably made from a stretchable material, such as, but not limited to, a elastic material.

Figure 3:
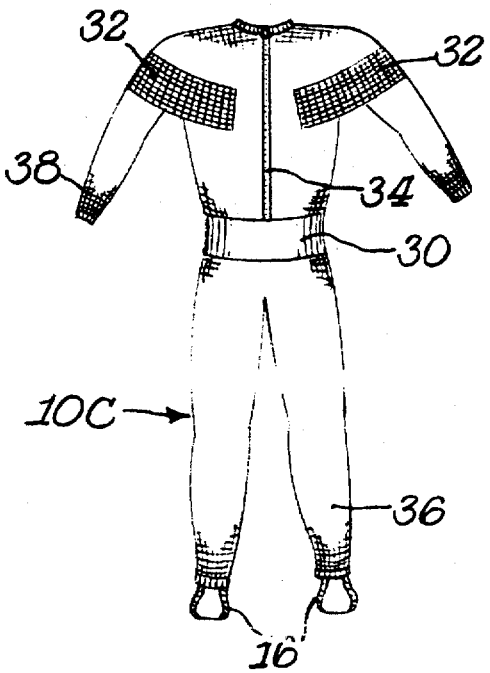
FIG. 3 shows a front elevational view of another one-piece resistance garment according to this invention.

FIG. 3 shows a front elevational view of another one-piece exercise suit according to the invention. The one-piece exercise suit 10C could be made of the same material and configuration as described in the one piece garment of FIG. 1. Around the waist in the exercise suit 10C can be a waistband 30. The waistband 30 can be a solid elastic material causing more tension in the exercise suit. In addition, elastic or a resistance material 32 can be on the upper portion of the exercise suit 10C. The elastic material 32 can be made of a mesh resistant web that would cause greater tension when a user moves his arms away from his body, thereby causing the user to burn up more calories during exercising. In order to get in and out of the suit easier, there could be access means 34 which could be the same as the access means 12 described in FIG. 1. The access means 34 could be in front, back or side of the exercise suit 10C. At the bottom of the legs could be foot stirrups 16 as described above in FIG. 1. The foot stirrups 16 would enable the suit to be pulled tighter against the user thereby creating more tension so that the user can burn more calories. In addition, a tightening means 38 can be at the end of the arms and the end of the legs 36 of the suit to form a snugger fit around the user's ankles and wrists, thereby creating more tension so that the user can burn more calories. The tightening means 38 can be, but is not limited to, having elastic material strips connected or sewn in the sleeves of the material in one direction and optionally have elastic material strips connected or sewn perpendicular to the first set of strips to create a strong elastic band. As described above in FIGS. 1 and 2, stirrups 14, 16, 20 and 24 can also be connected to the suit 10C.

FIG. 4 shows a front elevational view of still another one piece suit according to this invention. The exercise suit 10D can have a solid pair of pants 40 and an elastic mesh mid-section 42 and a solid top 44. There can be an access means 48 to permit the user to have easier access to get in and out of the suit 10D. The access means 48 could be the same as the access means 12 described in FIG. 1. The suit 10D have detachable or permanently connected boots or socks 50. The boots or socks 50 would be made of an elastic material such as, but not limited to LYCRA®, nylon, SPANDEX®, neoprene or rubber.

Figure 5:
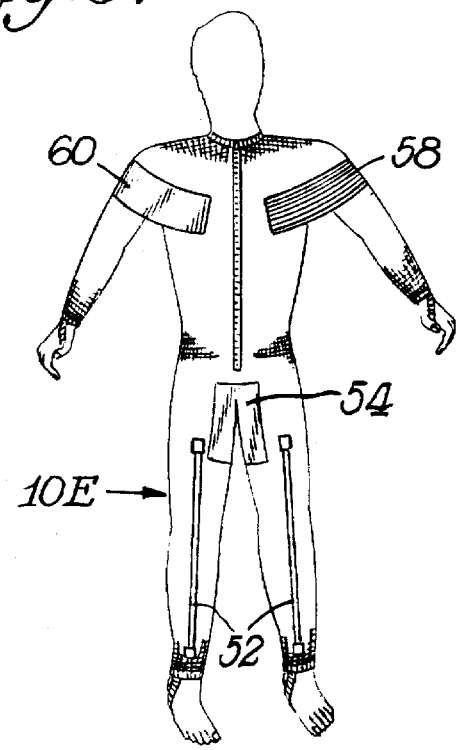
FIG. 5 shows a front elevational view of a further one-piece resistance garment.

FIG. 5 shows a front elevational view of a further one piece exercise suit according to this invention. The exercise suit 10E also has elongated elastic resistance elements or bands 52 attached to one or two of the legs of the suit. The elastic bands 52 which may be mounted beneath or above the suit 10E, preferably however, the bands 52 are formed within the suit by being disposed between individual layers. A similar type of construction is described in U.S. Pat. No. 5,306,222 issued to Wilkinson and the entire patent is incorporated by reference herein. The elastic resistance bands 52 can be adjustable or non-adjustable and would cause greater tension on the user while using the suit, thereby causing the user to burn more calories. The elastic resistance bands 52 can also be attached to the arm sleeves of the top 22. In addition, there could be an elastic web 54 inside the legs or at the crotch of the exercise suit 10E. Again, the elastic web 54 would enable more tension to be created when the user is using the suit 10E, thereby causing the user to burn up more calories. The web 54 can be permanently or detachably connected to the suit 10E. The web and the method of attachment could be similar to that described in U.S. Pat. No. 5,176,600 issued to Wilkinson and is the entire patent is incorporated by reference herein.

Figure 6:
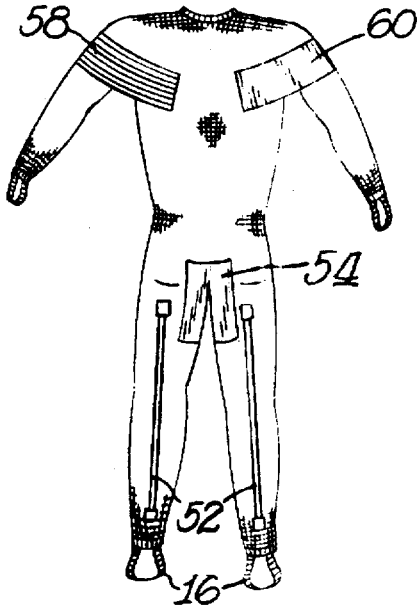
FIG. 6 shows a rear elevational view of FIG. 5.

FIG. 6 shows a rear elevational view of FIG. 5. The resistance garment can also have adjustable elastic resistance bands 52 attached to garment in any location. The elastic bands 52 elastic bands can be attached by any conventional means, such as but not limited to, snaps, buttons, VELCRO® or have the ends glued or sewn into place, etc. The elastic bands 52 have an adjust means 53. The adjust means can be, but is not limited to, a buckle to allow the user to tighten or loosen the resistance bands 52 tension. The bands 52 could be affixed to any desired location on the garment such as across the back, chest, legs or arms or having one end of the resistance band 52 affixed to the back and the other end of the band 52 affixed to the front of the garment. The strands 58 are shown on the upper arm on the body suit. Elastic web 59 is shown also on the other side of the arm of the suit 10E. The elongated elastic resistance element or strand 58 and elastic web 59 would create more tension thereby enabling the user to burn up more calories. The elastic strand 58 and web 59 would preferably be connected from the shoulders going across the front of the suit where the chest of the user would be. This would provide additional added resistance. It is also possible to provide webs as described in U.S. Pat. No. 5,176,600 issued to Wilkinson and is incorporated by reference herein.

Figure 7:
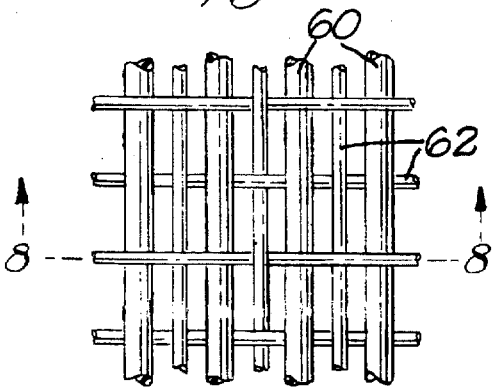
FIG. 7 shows an enlarged fragmental top plan view showing elastic cords sewn into a fabric.

FIG. 7 shows an enlarged fragmental top plan of another embodiment showing an elongated elastic element or cord 60 sewn directly into the fabric 62. The elastic cord 60 thereby can provide more tension and give the garment greater resistance. As stated above, the elastic cord 60 can be attached to the outside of the fabric, on the fabric, or can be sewn in the fabric as shown in FIG. 7. The elastic cord 60 can be sewn throughout the whole suit, or can be located in specific locations that the user wants to create greater resistance, such as in the chest, or the legs, or shoulders, or back, etc.

Figure 8:
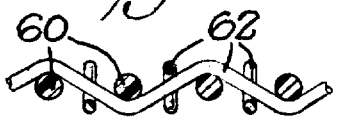
FIG. 8 shows a cross-sectional view in elevation taken along line 8—8 of FIG. 7

FIG. 8 shows a cross-sectional view in the elevation taken along the line 8—8 of FIG. 7. The woven fabric strand 62 are woven around the elastic cord 60. Thereby forming a suit having greater elasticity in the regions of the elastic coils are placed. It is also possible, instead of elastic cord 60 that a fabric of different material intensity can be sewn into the suit, which is by a continuous weave/variable density strips. This would also provide greater resistance in elasticity.

Figure 9:
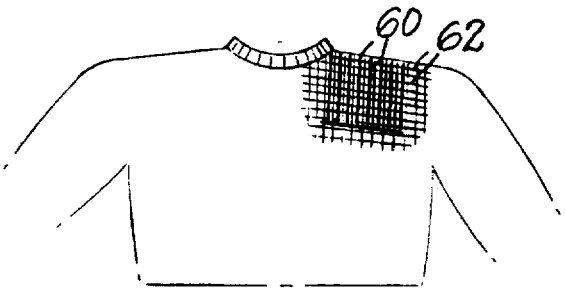
FIG. 9 shows a fragmental view of the upper top portion of an exercise garment showing elastic cords woven into a designated area of exercise.

FIG. 9 shows a fragmental view of an upper portion of an exercise garment showing panels which can be inserted on the garment, or can be sewn into the garment as shown in FIG. 9. The panels can provide greater resistance by being more elastic. The panels can have elastic cord 60 woven into the fabric. In addition, the panels can be continuous woven/variable density strips (as discussed above).

The clothing can come in different strengths and/or degrees of elasticity or thickness as to provide a progressive exercise/weight loss program and system. Thus, when a user becomes accustom to one strength level, the user can increase the aerobic weight loss effect by moving to a higher and greater resistance level. Garments of different elastic resistance strengths also serve to match the individual body strength of the user.

The garment can be worn as follows:

(1) underneath the outer clothing and next to the skin under the underwear of the user, (2) underneath the outer clothing and next to the skin as underwear of the user, (3) underneath the outer clothing but over top of the underwear, (4) as the clothing, (the outer wear) itself or (5) over the top of the clothing/outer wear.

As stated above, the garment can be at least one piece such as, but not limited to pants, shorts, briefs, boxers, long or short sleeve shirts, tank tops, sleeveless tops, vests, brassieres or one piece jump suit including a top and bottom such as an exercise suit covering all or part of the user's arms and legs (full sleeve, short sleeve, no sleeve, full leg, half leg, or above the knee).

The invention also relates to a process of burning up calories comprising a user wearing the garment for an extended period of time, thereby burning up calories. The user can gradually burn more calories by wearing the garment for a longer period of time or by changing the garment to a garment of greater resistance or of increased thickness and/or by adjusting the resistance of said garment.

While there is shown and described herein certain specific structure embodying the invention, it will be manifest to those skilled in the art that various modifications and rearrangements of the parts maybe made without departing from the spirit and scope of the underlying inventive concept and that the same is not limited to the particular forms herein shown and described.

I claim:

1. A process for creating conditions for burning calories comprising placing on a user a resistance garment having elongated elastic resistance elements which offer resistance to the movement of portions of a user's body, the elongated elements having resistance characteristics which differ from other portions of the garment, placing outer clothing on the user over the resistance garment, the user performing physical activities while wearing the clothing and the resistance garment wherein the physical activities include movement of at least some portion of the body having the resistance garment thereon, the resistance elements providing resistance to the movement during the physical activities to tend to burn calories in excess of the calories that are burned during the same physical activities when only the clothing is worn, wearing the clothing and resistance garment continuously for an extended period of time, and the elongated resistance elements being located longitudinally on the arm portions of the garment and being anchored to hand stirrups.

2. The process of claim 1 wherein the resistance garment is worn as part of a weight loss program and including the step of changing the resistance garment to a further resistance garment having different resistance characteristics during the weight loss program.

3. The process of claim 1 wherein the resistance garment is placed directly against and in contact with the user's skin.

4. A process for creating conditions for burning calories comprising placing on a user a resistance garment having elongated elastic resistance elements which offer resistance to the movement of portions of a user's body, the elongated elements having resistance characteristics which differ from other portions of the garment, placing outer clothing on the user over the resistance garment, the user performing physical activities while wearing the clothing and the resistance garment wherein the physical activities include movement of at least some portion of the body having the resistance garment thereon, the resistance elements providing resistance to the movement during the physical activities to tend to burn calories in excess of the calories that are burned during the same physical activities when only the clothing is worn, wearing the clothing and resistance garment continuously for an extended period of time, and the elongated resistance elements being located longitudinally on the leg portions of the garment and anchored to foot stirrups.

5. The process of claim 4 wherein the resistance garment is worn as part of a weight loss program and including the step of changing the resistance garment to a further resistance garment having different resistance characteristics during the weight loss program.

6. The process of claim 4 wherein the resistance garment is placed directly against and in contact with the user's skin.

7. A process for creating conditions for burning calories comprising placing on a user a resistance garment having elongated elastic resistance elements which offer resistance to the movement of portions of a user's body, the elongated elements having resistance characteristics which differ from other portions of the garment, placing outer clothing on the user over the resistance garment, the user performing physical activities while wearing the clothing and the resistance garment wherein the physical activities include movement of at least some portion of the body having the resistance garment thereon, the resistance elements providing resistance to the movement during the physical activities to tend to burn calories in excess of the calories that are burned during the same physical activities when only the clothing is worn, wearing the clothing and resistance garment continuously for an extended period of time, and the elongated resistance elements being located longitudinally on the arm portions of the garment and anchored to hand wear.

8. The process of claim 7 wherein the resistance garment is worn as part of a weight loss program and including the step of changing the resistance garment to a further resistance garment having different resistance characteristics during the weight loss program.

9. The process of claim 7 wherein the resistance garment is placed directly against and in contact with the user's skin.

10. A process for creating conditions for burning calories comprising placing on a user a resistance garment having elongated elastic resistance elements which offer resistance to the movement of portions of a user's body, the elongated elements having resistance characteristics which differ from other portions of the garment, placing outer clothing on the user over the resistance garment, the user performing physical activities while wearing the clothing and the resistance garment wherein the physical activities include movement of at least some portion of the body having the resistance garment thereon, the resistance elements providing resistance to the movement during the physical activities to tend to burn calories in excess of the calories that are burned during the same physical activities when only the clothing is worn, wearing the clothing and resistance garment continuously for an extended period of time, and the elongated resistance elements being located longitudinally on the leg portions of the garment and anchored to foot wear.

11. The process of claim 10 wherein the resistance garment is worn as part of a weight loss program and including the step of changing the resistance garment to a further resistance garment having different resistance characteristics during the weight loss program.

12. The process of claim 10 wherein the resistance garment is placed directly against and in contact with the user's skin.

13. In a resistance exercise garment having a body portion and limb portions wherein elongated elastic resistance elements are included in said garment to provide a force that resists movement of the user to cause the user to expend energy to oppose the force provided by the elastic resistance elements for enhancing the exercise value of a physical activity, the improvement being in at least a portion of said garment is made of a variable resistance fabric, said variable resistance fabric including a plurality of generally parallel first strands, said variable resistance fabric further including a plurality of generally parallel second strands perpendicular to said first strands, said second strands being elastic and having greater resistance force than the resistance force of said first strands, said second strands comprising said elastic resistance elements, and hand stirrups connected to said variable resistance fabric to provide anchor structure.

14. The garment of claim 13 wherein said variable resistance fabric is located at spaced sections of the garment.

15. The garment of claim 13 including foot stirrups connected to said variable resistance fabric to provide anchor structure.

16. In a resistance exercise garment having a body portion and limb portions wherein elongated elastic resistance elements are included in said garment to provide a force that resists movement of the user to cause the user to expend energy to oppose the force provided by the elastic resistance elements for enhancing the exercise value of a physical activity, the improvement being in at least a portion of said garment is made of a variable resistance fabric, said variable resistance fabric including a plurality of generally parallel first strands, said variable resistance fabric further including a plurality of generally parallel second strands perpendicular to said first strands, said second strands being elastic and having greater resistance force than the resistance force of said first strands, said second strands comprising said elastic resistance elements, and said variable resistance fabric being connected to foot stirrups to provide anchor structure.

17. The garment of claim 16 wherein said garment is a one piece suit having upper body and lower body portions and arms and leg portions.

18. The garment of claim 16 wherein said garment is a two piece suit having separate shirt and pants portions.

19. The process of claim 16 wherein the resistance garment is placed directly against and in contact with the user's skin.

* * * * *